US008001985B1

(12) United States Patent
Conner

(10) Patent No.: US 8,001,985 B1
(45) Date of Patent: Aug. 23, 2011

(54) SELF-CONTAINED SHELTER

(76) Inventor: Michael R. Conner, Santa Barbara, CA (US)

( * ) Notice: Subject to any disclaimer, the term of this patent is extended or adjusted under 35 U.S.C. 154(b) by 162 days.

(21) Appl. No.: 12/389,175

(22) Filed: Feb. 19, 2009

(51) Int. Cl.
*E04H 15/02* (2006.01)

(52) U.S. Cl. ..... 135/96; 135/904

(58) Field of Classification Search ..... 135/114, 135/116, 137, 904, 95, 99; 206/223; 52/2.11
See application file for complete search history.

(56) References Cited

U.S. PATENT DOCUMENTS

| | | | | | |
|---|---|---|---|---|---|
| 2,363,917 | A * | 11/1944 | Waterman et al. | 135/116 |
| 2,600,501 | A * | 6/1952 | Higgs | 600/22 |
| 2,883,713 | A * | 4/1959 | Zug | 52/71 |
| 3,017,194 | A * | 1/1962 | Anderson | 280/18 |
| 3,425,428 | A * | 2/1969 | Schwartz | 135/114 |
| 3,497,606 | A * | 2/1970 | La Vern et al. | 174/379 |
| 3,629,875 | A * | 12/1971 | Dow et al. | 4/599 |
| 3,826,270 | A * | 7/1974 | Hentges | 280/19.1 |
| 4,585,020 | A * | 4/1986 | Masuda et al. | 135/95 |
| 4,876,829 | A * | 10/1989 | Mattick | 52/2.18 |
| 5,477,876 | A * | 12/1995 | Moss | 135/97 |
| 5,622,198 | A * | 4/1997 | Elsinger | 135/128 |
| 5,918,614 | A * | 7/1999 | Lynch | 135/95 |
| 6,253,498 | B1 * | 7/2001 | Fanucci | 52/69 |
| 6,708,451 | B1 * | 3/2004 | Gomes | 52/2.17 |
| 7,774,987 | B2 * | 8/2010 | Pfeiffer | 52/2.17 |
| 2008/0060691 | A1 * | 3/2008 | Harker | 135/95 |
| 2008/0110484 | A1 * | 5/2008 | Doran | 135/121 |

* cited by examiner

*Primary Examiner* — Noah Chandler Hawk
(74) *Attorney, Agent, or Firm* — Richard S Erbe

(57) ABSTRACT

A self-contained shelter that may be used for survival purposes or recreational activities includes a number of floor panels, a number of which form an enclosure, which may be held together by one or more straps. Inside the enclosure are several more floor panels, an inflatable tent, and life-supporting accessories. The shelter, when the enclosure is secured, may be airdropped or trucked into an area that may have experienced a recent disaster, such as flooding, hurricanes, or earthquakes. For recreational purposes, the shelter may be placed in a motor vehicle. When the straps are released, the floor panels may be attached along their edges to each other to form a raised floor that is placed on a surface. A raised floor provides a buffer between the user of the shelter and the surface, which may be wet or muddy. The tent is inflated and attached to the floor and is supported by external beams and internal braces. The tent forms an air chamber that provides insulation from the outside. Life-supporting accessories include food, water, clothing, inflatable mattresses, cooking stove, lanterns, communications equipment, blankets, power supplies and the like. The self-contained shelter may be readily assembled in a few minutes and provides the user a complete facility, rather than a basic tent which will require the user to acquire other necessities by leaving the tent or waiting for other items to be brought in.

11 Claims, 11 Drawing Sheets

SELF-CONTAINED SHELTER

RELATED APPLICATIONS

Not applicable.

BACKGROUND OF THE INVENTION

1. Field of the Invention

The present invention relates to the field of outdoor living and, more particularly, to a self-contained shelter that may be used to aid those who have suffered the consequences of a manmade or natural disaster, in the form of a shelter, command post, temporary hospital. The present invention may also be used for other activities, such as camping, trade shows, fairs, and retail events.

2. General Background and State of the Art

According to reliable statistics, the number of reported disasters has increased globally by 1383% over the past fifty years. Such disasters as hurricanes, floods, earthquakes, fires, tsunamis and the like have affected humans in increasing numbers. Much of the increase can be attributed to the changes in life styles during the twentieth century, where many societies went from an agricultural rural environment to more urban societies that are concentrated along major rivers and coastlines. Unfortunately, these areas are where many natural disasters take place.

It is known that after a disaster, the first 72 hours following such disaster are critical to human well-being and survival. Temporary relief trailers and tents, such as those provided by the Federal Emergency Management Agency (FEMA) in the United States, do not adequately address the needs of people in distress, who not only require shelter but also food, water, shelter, first aid, heat, and communications. For people whose homes have been destroyed, rendered unlivable, or made inaccessible by a natural or manmade disaster, the lack of these basic necessities can lead to stress, violence, and the spread of disease.

Efforts at providing such necessities are woefully inadequate. FEMA trailers and tents represent the standard temporary disaster housing solutions at present, but they fail in many ways. Neither contains the essential survival components upon delivery; neither is recyclable after use; trailers must be towed through disaster debris, which in many situations may not be possible. Tents are labor intensive to set up, are not insulated, and have no real floor.

Much the same could be said for known recreational camping gear. A person going camping must remember to gather all of the necessities to make the camping experience fun and meaningful. Forgetting an essential life supporting accessory, such as a first aid kit, can ruin a camping experience.

Also, for many who are not experienced campers, they may not known just what types of things they need to bring and may not know how to easily and efficiently erect a tent, which can lead to frustration and also ruin a camping experience.

It would be desirable, therefore, to provide a self-contained shelter that can be used for surviving disasters or for other activities including recreational camping that provides all of the needed essentials, such as shelter, water, food, communications, warmth, and first aid, all in an easily transportable package that does not require any specialized knowledge to deploy in an emergency or other chosen site.

The inventor is unaware of any such product available or under consideration that meets all of these requirements.

SUMMARY OF THE INVENTION

It is therefore an object of the present invention to provide a self-contained shelter that supplies the necessities of food, water, communications, first aid, heat, and shelter.

It is another object of the present invention to provide a self-contained shelter that is easily transportable and may be delivered to effected areas within seventy-two hours.

A further object of the present invention to provide a self-contained shelter that provides more effective disaster preparedness.

Still a further object of the present invention to provide a self-contained shelter that is made almost entirely from recyclable materials.

Yet another object of the present invention to provide a self-contained shelter that is easy to assemble and requires no special knowledge or skills.

Another object of the present invention to provide a self-contained shelter that is less expensive to produce than conventional shelters.

Still another object of the present invention to provide a self-contained shelter that may be used to support those affected by any kind of disaster.

A further object of the present invention to provide a self-contained shelter that may be stored in a compact space.

It is yet another object of the present invention to provide a self-contained shelter that does not have to be towed.

Another object of the present invention to provide a self-contained shelter that provides a raised floor for the user that separates the user from the ground.

Still a further object of the present invention to provide a self-contained shelter that provides insulating features to help keep the user warm.

Yet another object of the present invention to provide a self-contained shelter makes effective use of all components contained in it.

A further object of the present invention to provide a self-contained shelter that includes an inflatable tent that is has insulating characteristics.

Another object of the present invention to provide a self-contained shelter that can be used for survival purposes and for recreational purposes.

These and other objectives are achieved by the present invention. In accordance with the invention, a self-contained shelter includes a raised floor made from a number of panels that may be easily fitted together. The self-contained shelter includes an inflatable tent, supports for the tent, and life support accessories including food, water, communication equipment, cooking gear, first-aid equipment, lighting, inflatable furniture, mattresses and the like.

A self-contained shelter according to a preferred embodiment of the present is provided in an enclosure that is made of a number of raised floor panels, preferably constructed of a hard plastic. In the preferred embodiment, six rectangular floor panels form the enclosure, although the enclosure could be made up of another number of floor panels without departing from the scope of the invention. The enclosure, when it is delivered to the sight, is generally secured by one or more straps and encloses additional floor panels, the inflatable tent, structural members for the tent, and the life supporting accessories.

The self-contained shelter according to the present invention may be air-dropped, trucked in, wheeled, carried or dragged to the desired location. The straps are then released and the floor panels that form the enclosure are deployed and attached to one another by means of hinges (such as may be found in a door hinge with a barrel and pin construction), dowels, or other conventional means. The remaining unattached floor panels, inflatable tent, structural members and life-supporting accessories are ready for deployment. The floor panels that were in the enclosure are also attached to the other floor panels.

Preferably, the floor panels are all of the same size and can be attached to one another along their edges by various means, such as hinges, latches, dowel pins, or other known conventional attaching means. As noted previously, each floor panel has a number of feet on its bottom surface and carpet on the top surface. This construction allows the shelter to be raised off the ground and provides a buffer from wet, muddy conditions and adds to the insulating and comfort qualities provided by the shelter, as well as stability on uneven surfaces. On one of the floor panels is attached a cooking stove, adding a capability to the shelter according to the present invention not found in conventional shelters. The inventor has found that using nine 48-inch by 48-inch floor panels meets the intended objects of the invention and provides the user with all of the required comforts and functions; however, it should be noted that panels of a different size and number could be used with the shelter of the present invention without departing from the scope of the invention. For recreational camping, for example, it may be desired to use smaller panels making the unit lighter in weight and even easier to transport.

An inflatable tent, inflatable outside support beams and, if needed for a particular application, internal braces, are also included with the shelter. The tent is attached to the raised floor. The outside support beams, are then inflated. The beams form a separate and distinct single air chamber that is mechanically attached (preferably by straps and/or adhesive) to the outside of the tent.

A beam header is placed on the tent to secure the beams where they meet near the top of the tent.

Once the beams are in place, the tent is inflated, and the beams are attached to the outer layer of the tent. The tent forms separate and distinct air chambers from the beams and provides and insulating rating of about R35 between the inner layer and the outer layer. A number of structural braces, preferably made of PCV, are assembled and inserted to mounting sockets in the raised floor and the inside surface of the tent. Shelves and tables, which include openings for the structural braces, may be mounted on the braces to provide eating and working spaces and places to put other gear. A flue pipe is connected to the stove and extends through an opening in the top of the tent and the beam header. Use of external beams as well as internal bracing helps maintain the integrity of the shelter, even in windy, rainy and snowy conditions.

Once the raised floor, tent, beams and structural braces are in place, the user can arrange the life support accessories as desired. The accessories are included in a number of containers within the enclosure when the shelter is delivered, and the containers themselves are designed to serve as furniture for seats, tables and the like. Electrical components are powered by a 12 volt battery which is recharged with an attached solar powered trickle charger, or wind powered generator.

Several thousand of the self-contained shelters according to the present invention may be stored conveniently in a standard 10,000 square foot warehouse, ready for quick deployment. Conventional survival shelters, such as those provided by FEMA, require much larger storage areas.

Further objects and advantages of this invention will become more apparent from the following description of a preferred embodiment of the invention, which, taken in conjunction with the accompanying drawings, will illustrate, by way of example, the principles of the invention.

BRIEF DESCRIPTION OF THE DRAWINGS

The foregoing and other aspects and advantages will be better understood from the following detailed description of the several embodiments of the invention with reference to the drawings in which.

DETAILED DESCRIPTION OF THE PREFERRED EMBODIMENT OF THE INVENTION

In the following description of the invention, reference is made to the accompanying drawings, which form a part thereof, and in which is shown, by way of illustration, an exemplary embodiment illustrating the principles of the self-contained shelter of the present invention and how it may be practiced. It is to be understood that other embodiments may be utilized to practice the present invention and structural and functional changes may be made thereto without departing from the scope of the present invention.

Figure 1:
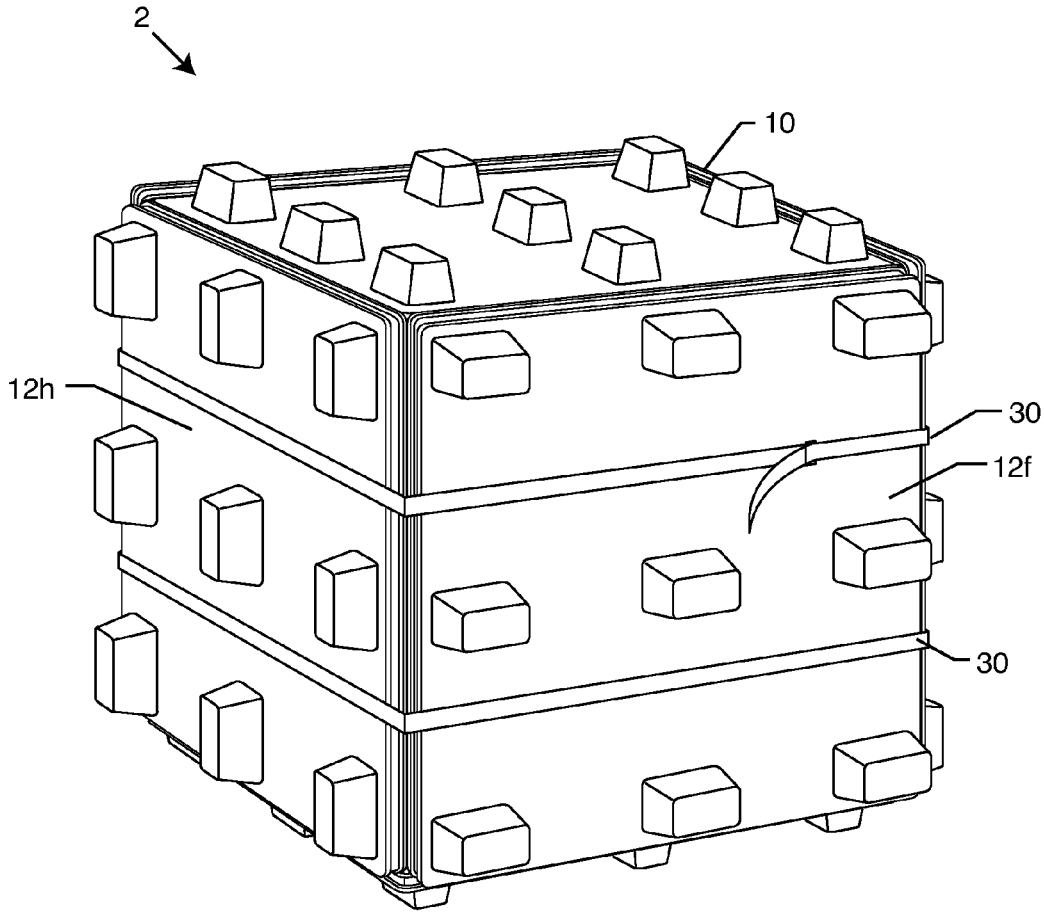
FIG. 1 illustrates a perspective view of an exemplary self-contained shelter according the present invention in its enclosed configuration.
Figure 2:
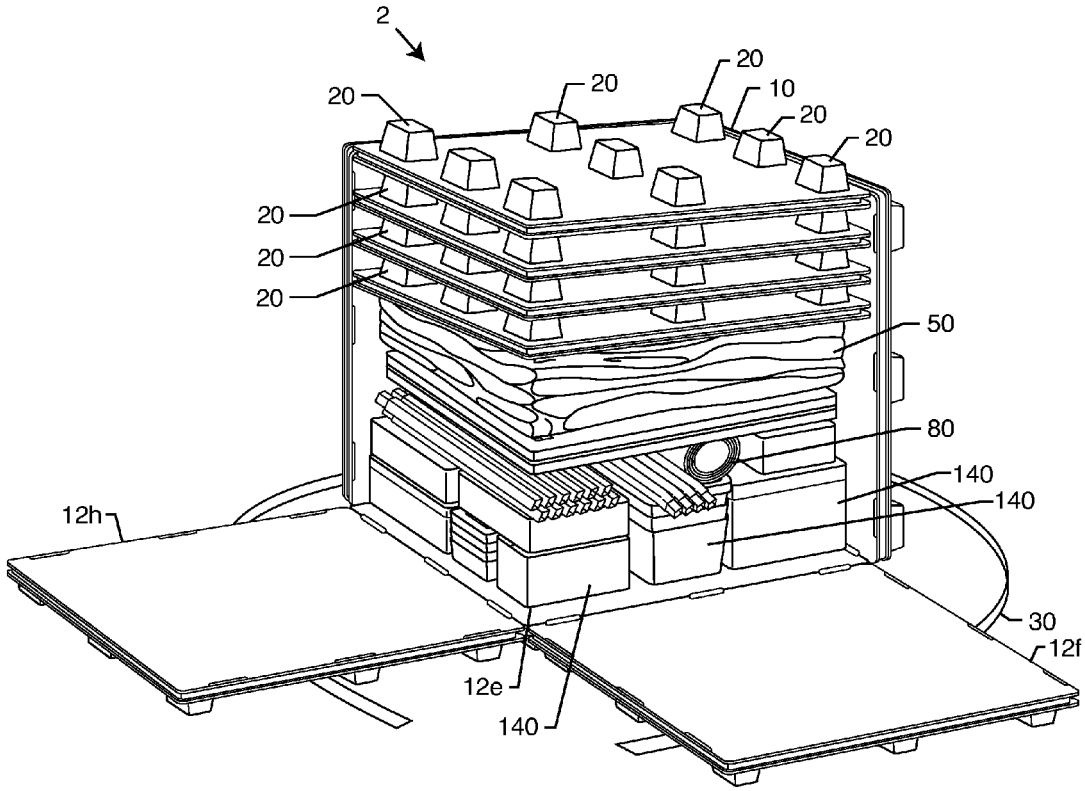
FIG. 2 illustrates a perspective view of an exemplary self-contained shelter according the present invention with the enclosure partially opened.
Figure 3:
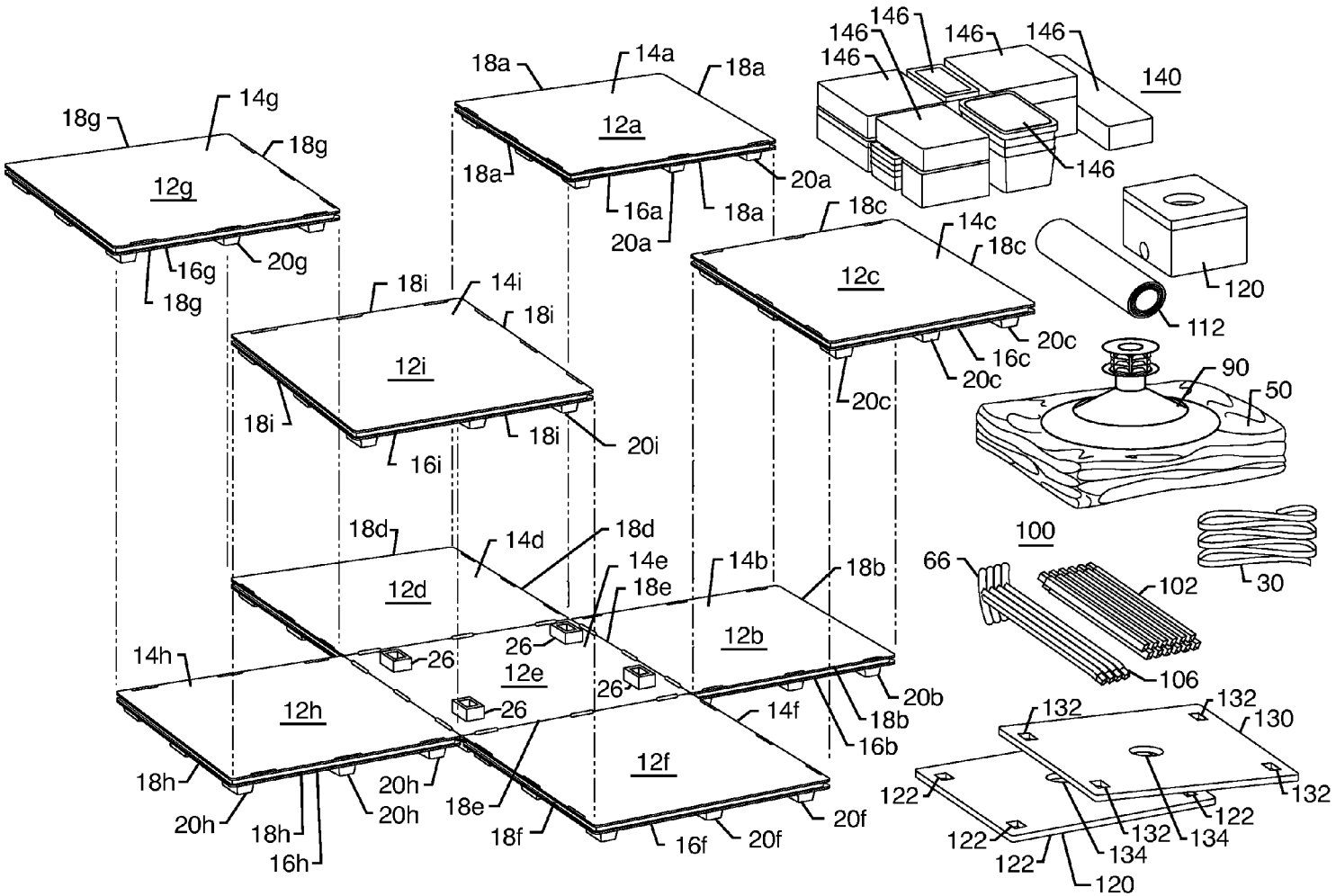
FIG. 3 illustrates an exploded view of an exemplary self-contained shelter according the present invention.

A self-contained shelter according to a preferred embodiment of the present invention is illustrated in the included drawing figures and is indicated generally by the numeral 2. FIGS. 1-3 illustrate how self-contained shelter 2 may be provided in an enclosure 10, which contains all of the components necessary to assemble shelter 2.

FIG. 1 illustrates enclosure 10 secured by one or more straps 30. Enclosure 10 is made up of a number of floor panels generally numbered 12. In the preferred embodiment of the invention, enclosure 10 includes six floor panels 12 secured by straps 30. Enclosure 10 also holds additional floor panels 12, inflatable tent 50, beams 80, internal braces 100 if needed, and life support accessories 140.

FIG. 2 shows enclosure 10 partially opened after straps 30 have been released, while FIG. 3 illustrates how all of the necessary components are contained inside enclosure 10 to form shelter 2.

In the embodiment disclosed herein, there are nine floor panels 12, which preferably have the same size and structure. Six floor panels 12 make up enclosure 10, while the other three floor panels 12 are contained inside enclosure 10. It will be apparent to those skilled in the art that the number of floor panels can be varied from the nine shown in the example illustrated, as can the shape and sizes of the floor panels, without departing from the scope of the invention.

Each floor panel 12 includes a top surface 14, bottom surface 16, a plurality of sides 18, and a number of projecting feet 20, the purpose of which will be discussed shortly. In this exemplary embodiment of the invention, the floor panels are designated as 12*a* through 12*i*, and their component numbers are as follows:

| Floor Panel Number | Top Surface | Bottom Surface | Sides | Feet |
|---|---|---|---|---|
| 12a | 14a | 16a | 18a | 20a |
| 12b | 14b | 16b | 18b | 20b |
| 12c | 14c | 16c | 18c | 20c |
| 12d | 14d | 16d | 18d | 20d |
| 12e | 14e | 16e | 18e | 20e |
| 12f | 14f | 16f | 18f | 20f |
| 12g | 14g | 16g | 18g | 20g |
| 12h | 14h | 16h | 18h | 20h |
| 12i | 14i | 16i | 18i | 20i |

Figure 4:
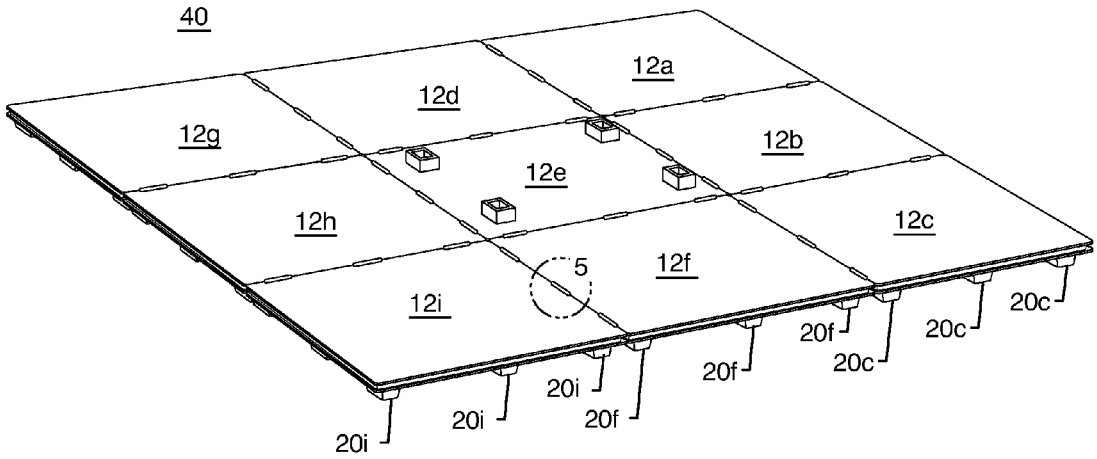
FIG. 4 illustrates a perspective view of the connected floor panels forming a raised floor in an exemplary self-contained shelter according the present invention.

In the exemplary embodiment illustrated, enclosure 10 is formed by floor panel 12*e*, with floor panels 12*b*, 12*d*, 12*f*, and 12*h* attached to floor panel 12*e* along a corresponding side to one of sides 18*e*. After the enclosure is opened, floor panels 12*a*, 12*c*, 12*g* and 12*i* are attached along at least one of their sides to at least one side of an adjoining floor panel, as best illustrated in FIGS. 3 and 4. The assembled floor panels 12*a* through 12*i* form a raised floor 40, best shown in FIG. 4. Feet 20 on the bottom surfaces of the floor panels raise the level of the floor panels off of the surface on which shelter 2 rests, thus creating raised floor 40. This construction allows shelter 2 to be raised off the ground and provides a buffer from wet, muddy conditions and adds to the insulating and comfort qualities provided by shelter 2. Feet 20 also provide stability to shelter 2 when it is deployed on an uneven surface.

Figure 5:
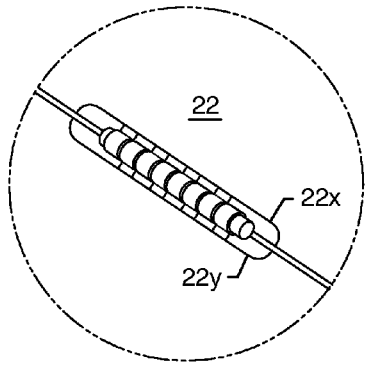
FIG. 5 illustrates a sectional view taken along circle 5 in FIG. 4.

Attachment of floor panels 12 to one another may be achieved by a variety of attachment means 22 along the floor panel sides 18. FIG. 5 illustrates a conventional door hinge construction, with hinge barrel 22*x* mounted on a floor panel side and pin 22*y* mounted on an adjoining floor panel side. It should be noted that a variety of attachment structures could be used for attachment means 22, such as latches, pins, or other known conventional attaching means.

Figure 6:
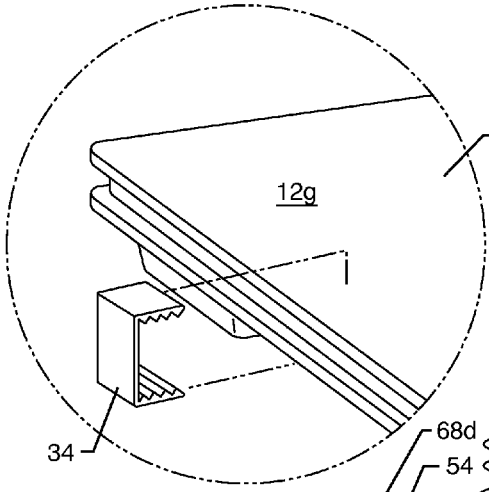
FIG. 6 illustrates a detail of the connecting means connecting the inflatable tent to the raised floor in an exemplary self-contained shelter according the present invention.
Figure 7:
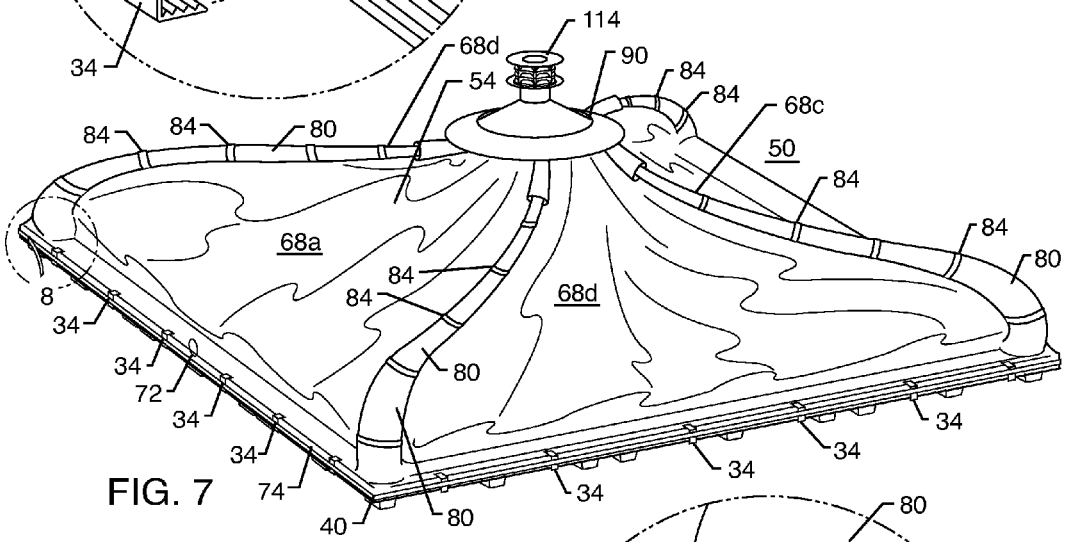
FIG. 7 illustrates a perspective view of an exemplary self-contained shelter according the present invention with the inflatable tent attached to the raised floor.

After raised floor 40 is assembled and put in place, the life support accessories 140 are placed to the side off of raised floor 40 while inflatable tent 50 is attached to raised floor 40 and inflated. FIGS. 6 through 9 illustrate how tent 50 is secured to raised floor 40. FIG. 6 shows a typical example of clip 34, a plurality of which may be used to secure tent 50 to raised floor 40. FIG. 7 illustrates how tent 50, while still not inflated, is secured to the floor panels of raised floor 40 by using clips 34 around the perimeter of raised floor 40, to secure tent skirt 74 to raised floor 40.

Alternatively, tent 50 may be attached to raise floor 40 by means of a plurality of "D-rings" attached to outer layer 54 of tent 50. Each D-ring has an opening through which one end of an adjustable strap is passed. At the other end of the strap is a hook that may be attached to bottom surface 16 of a floor panel 12. The adjustable strap is then tightened for a more secure fit.

Figure 8:
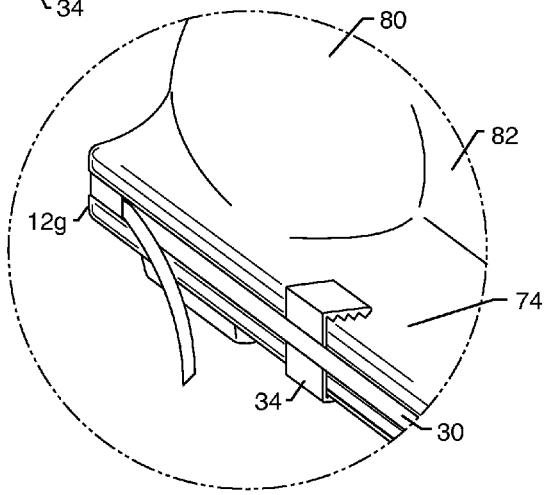
FIG. 8 illustrates a sectional view taken at circle 8 in FIG. 7.
Figure 9:
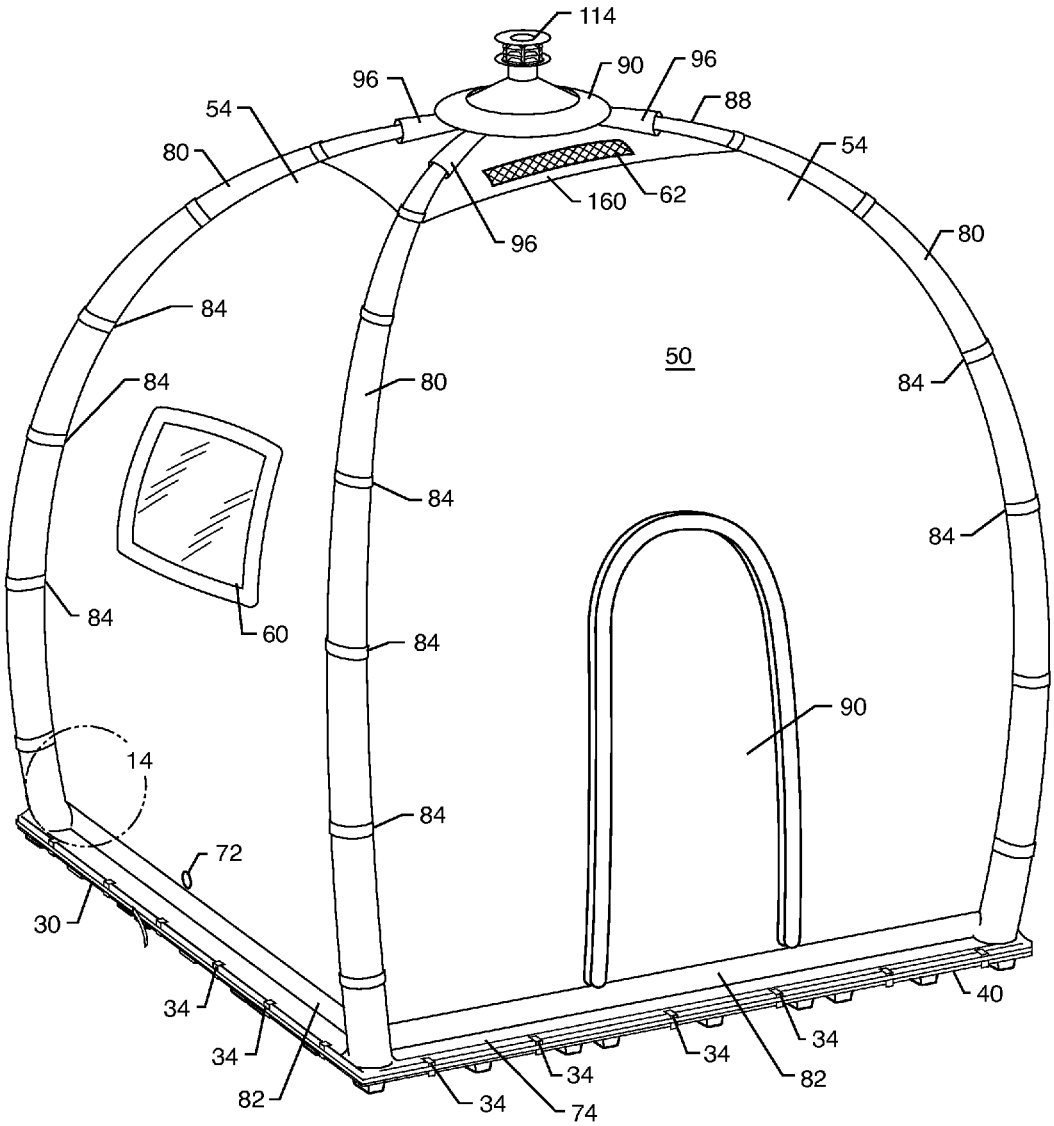
FIG. 9 illustrates a perspective view of an exemplary self-contained shelter according the present invention, with the tent inflated.

Once clips 34 are in place, securing strap 30, as best illustrated in FIG. 8, is secured to the perimeter of raised floor 40 to provide a more secure attachment of tent 50 to raised floor 40. With tent 50 secured to raised floor 40, tent 50 can now be inflated by conventional means. FIG. 9 shows tent 50 in its inflated condition. Tent 50 includes inner layer 52, outer layer 54, door 90, and window 60. Inner layer 52 and outer layer 54 are preferably constructed of a ¼" thick nylon web mesh, such as messathan. When tent 50 is inflated, the air space between layers 52 and 54 provides an insulating layer with an insulation factor of approximately R35. Tent 50 forms distinct air chambers 68*a*-68*d* that are separate from the air chamber of support beams 80.

A number of inflatable support beams 80, which form a separate and distinct air chamber 88, are inflated and attached to outer surface 54 of tent 50 by attachment means 84. In the example disclosed, attachment means 84 are straps, each of which is disposed around a beam 80 and attached to outer surface 54 of tent 50 by means of hook and loop construction, or other means such as buttons, zippers or the like and may also include an adhesive. Beams 80 provide external structural support to tent 50. Base beam 82 is in fluid communication with beams 80 and is disposed about the perimeter of tent 50.

Beams 80 are joined near the top of tent 50 at beam header 90, which is best illustrated in FIGS. 9-13. Beam header 90 includes a top surface 92, bottom surface 94, and a plurality of beam sockets 96 on bottom surface 94. Each beam socket 96 provides a termination point for each beam 80, where the beams may be secured and sealed off. Beam header 90 also includes exhaust port 114 for stove 110. Also located near the top of tent 50 is component platform 160, on which a number of objects, such as solar panel 62, may be mounted.

Figure 14:
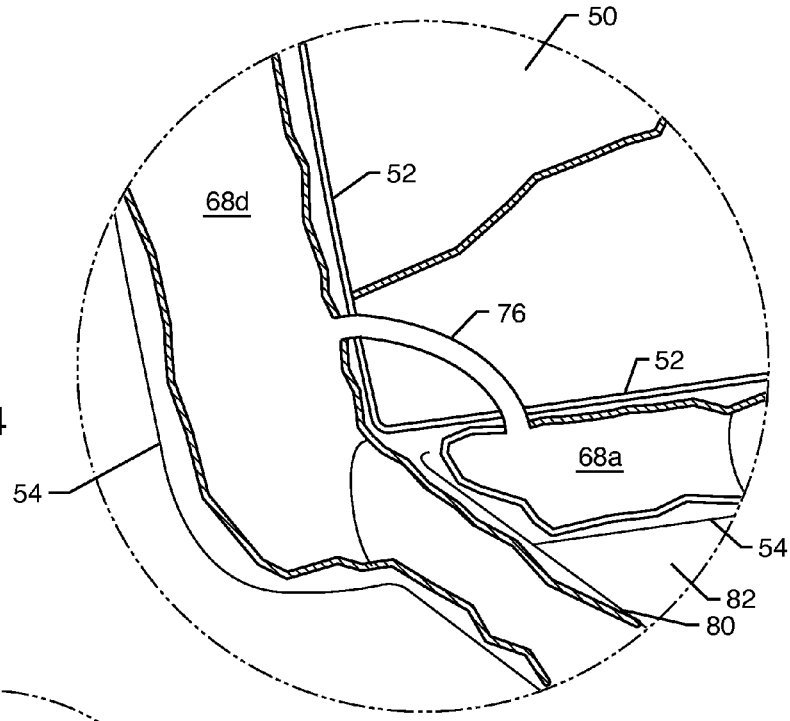
FIG. 14 illustrates a sectional view taken at circle 14 in FIG. 9.
Figure 15:
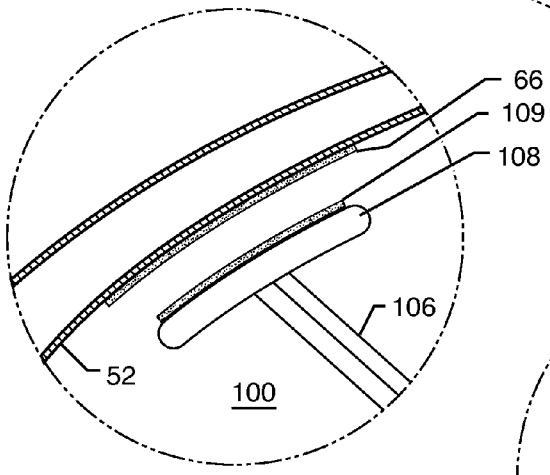
FIG. 15 illustrates a detailed view of the attachment means for attaching the braces to the tent in an exemplary self-contained shelter according the present invention.
Figure 16:
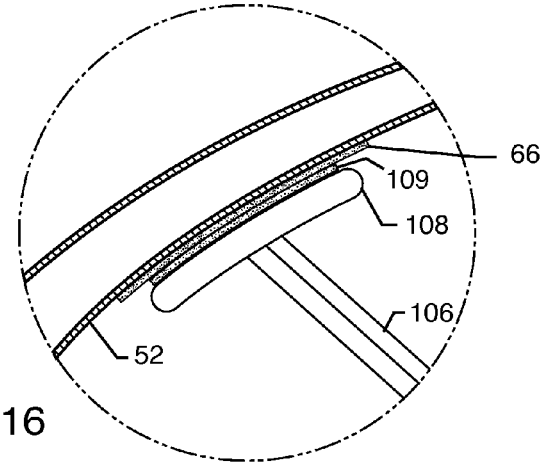
FIG. 16 illustrates a sectional view taken at circle 16 in FIG. 12.

FIG. 14 illustrates how tent 50 is comprised of separate air chambers. In FIG. 14, air chamber 68*d* and 68*a* are separate air chambers connected by air tube 76, which allows air to pass between the air chambers during the process of inflating tent 50.

FIGS. 10, 13, 15 and 16 illustrate the internal structural support of tent 50 as well as some of the other features of shelter 2. For certain applications of shelter 2, the internal structural support may not be needed, but where high wind loads or snow are experienced, such internal structural supports would be very desirable. A plurality of braces 100 each include a number of straight members 102 connected together, and an angled member 106 connected to a straight member. At one end of angled member 106 is mounting head 108, which includes an attachment pad 109, which in the exemplary embodiment described, is a hook and loop strip. The attachment pad 109 abuts connector 66 on inner surface 52 of tent 50. The opposite end of each brace 100 is inserted into a mounting socket 26, which is attached to top surface 14*e* of floor panel 12*e*. Connector 66, in the exemplary embodiment illustrated, is of a hook and loop construction. Braces 100 are preferably constructed of a strong polymer, such as polyvinyl chloride, and may be round or rectangular in shape.

Figure 10:
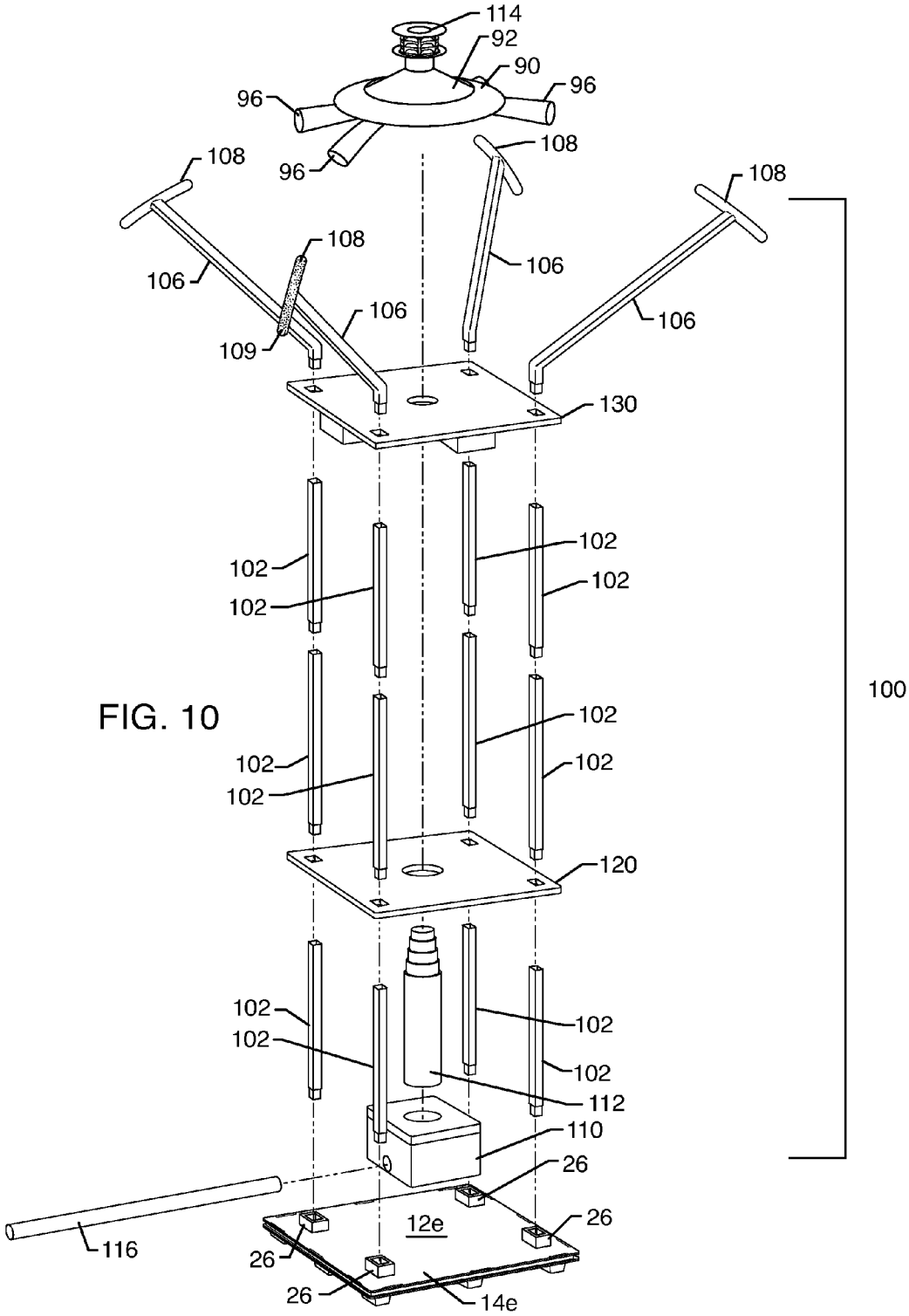
FIG. 10 illustrates an exploded view of the internal braces and other features in an exemplary self-contained shelter according the present invention.
Figure 11:
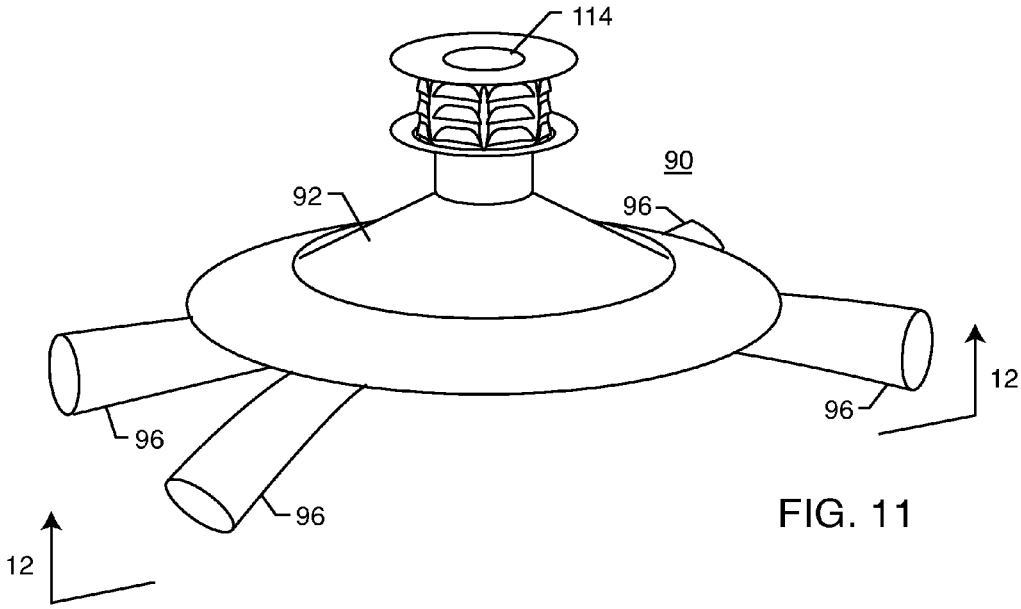
FIG. 11 illustrates a perspective view of the beam header for use with an exemplary embodiment self-contained shelter according to the present invention.
Figure 12:
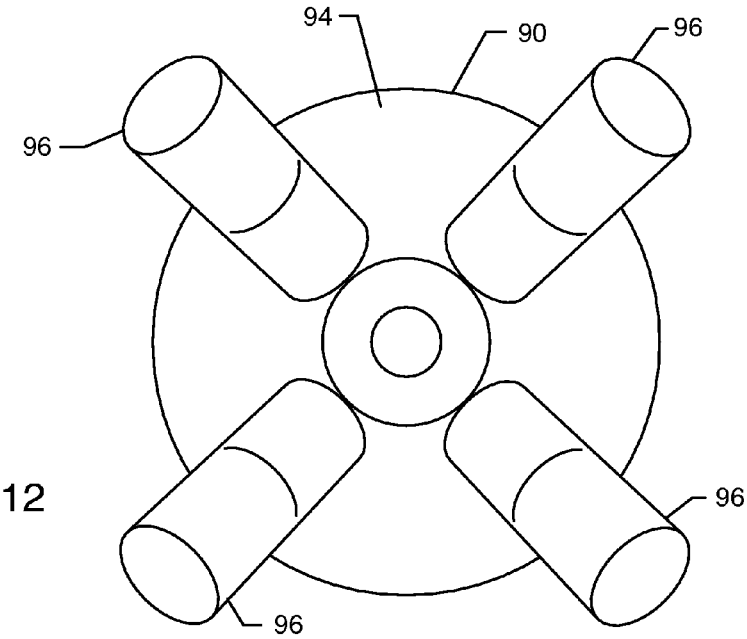
FIG. 12 illustrates a bottom view of the beam header for use with an exemplary embodiment self-contained shelter according to the present invention.
Figure 13:
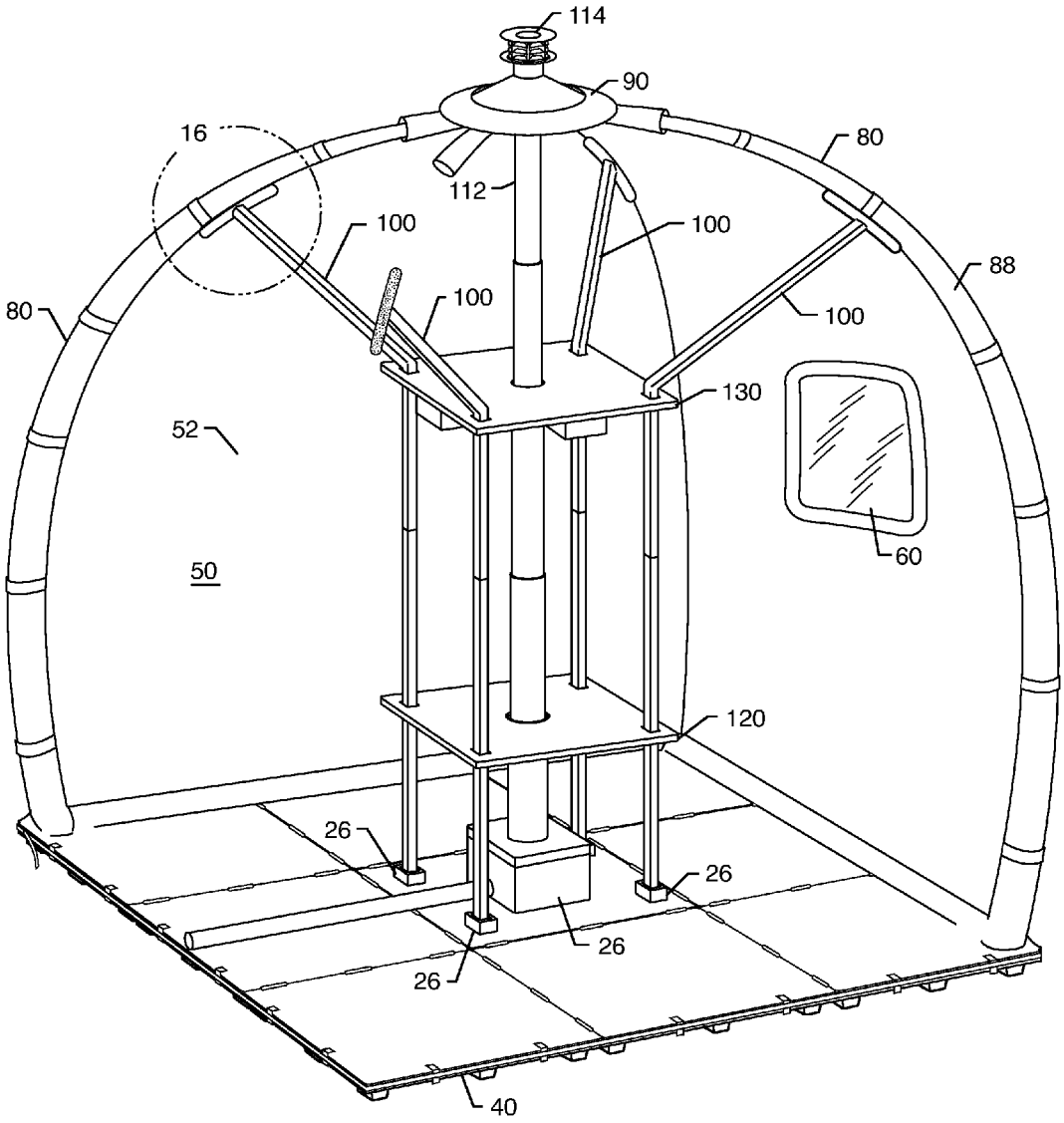
FIG. 13 illustrates a sectional view of an exemplary self-contained shelter according the present invention.

FIGS. 10 and 13 also illustrate how table 120 and shelf 130 may be attached to braces 100 by allowing straight members 102 to pass through openings 122 in table 120 and openings 132 in shelf 130.

Shelter 2 also includes a stove 110, which mounts to floor panel 12*e*. Flue 112, which is of a telescoping structure, mounts on stove 110 and passes through opening 124 in table 120 and opening 134 in shelf 130 through an opening in tent 50 to exhaust 114 in beams header 90. Air intake pipe 116 provides air to the stove and exits tent 50 through opening 72.

Figure 17:
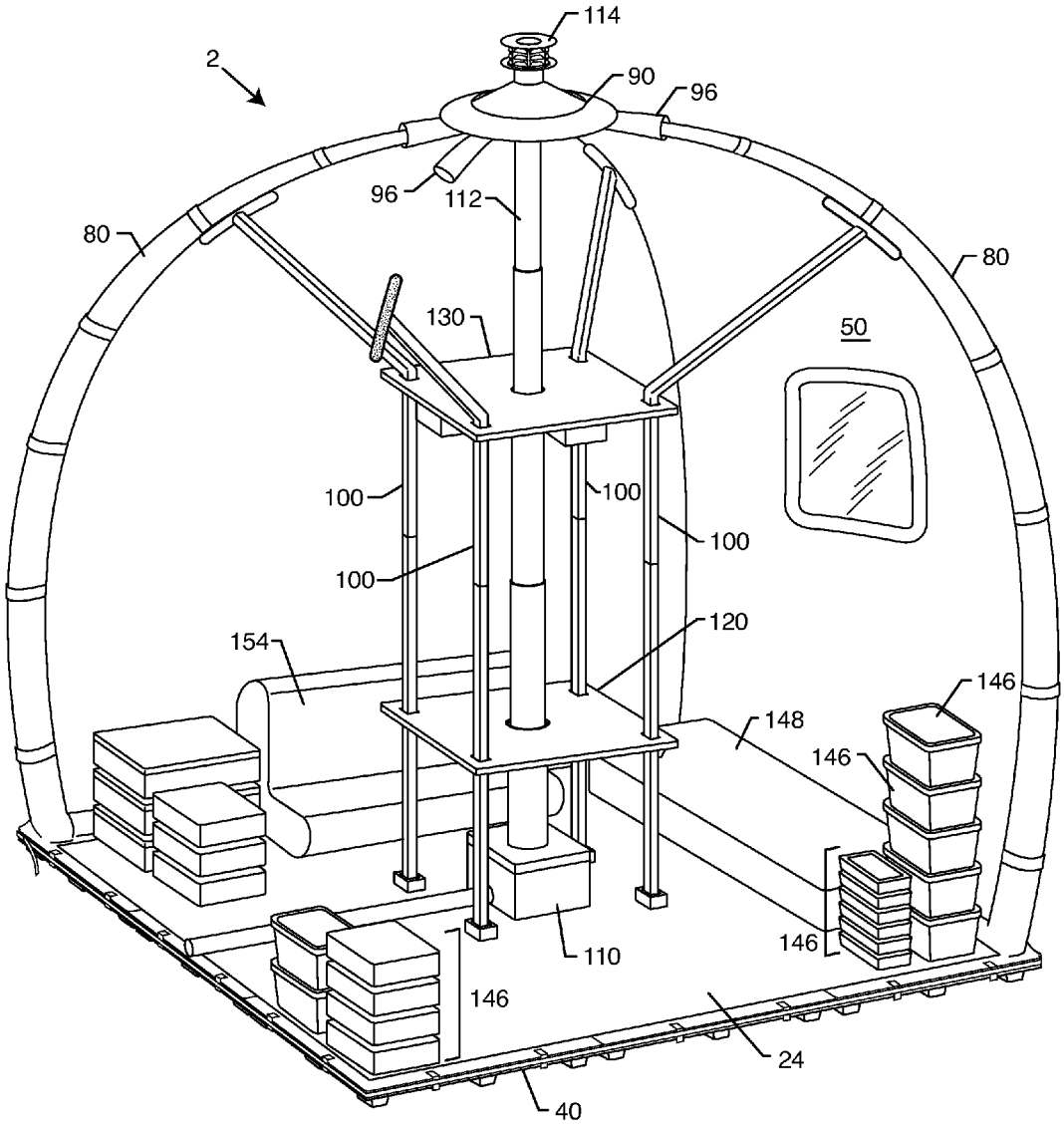
FIG. 17 illustrates a partial sectional view of a fully-deployed exemplary self-contained shelter according to the present invention.

FIG. 17 illustrates the fully-deployed shelter 2, with tent 50 mounted on raised floor 40. Containers 146 contain food, clothing, first aid, water, batteries, a power supply, shovel, cordless tools, communications equipment, lanterns and other supplies necessary to support persons using shelter 2. Other features include inflatable mattress 148 and inflatable sofa 152. The top surfaces 14*a* through 14*i* of floor panels 12*a* through 12*i* may be covered by carpet 24 for additional comfort.

Method of Deploying and Erecting the Self-Contained Shelter. The method of deploying and erecting shelter 2 will now be described. Enclosure 10, formed by a number of floor panels 12 and secured by one or more straps 30, is provided (FIG. 1). Enclosure 10 also contains a number of additional floor panels 12 contained inside of said it, inflatable tent 50 having an inner layer 52 and an outer layer 54, attachable inflatable beams 80, braces 100, and a plurality of life-support accessories 140.

Straps 30 are released (FIG. 2); floor panels 12*a* through 12*i* are connected to each other to form raised floor 40 (FIGS. 3-5). Life-support accessories 140 are moved off of and away from raised floor 40.

Tent 50 is then secured to raised floor 40; tent 50 and beams 80 are inflated. Beams 80 are attached to outer layer 54 of tent 50, and secured to beam sockets 96 in beam header 90 (FIGS. 6-9).

The structural braces 100, if needed, are assembled and disposed between sockets 26 on floor panel 12*e* and the inner layer 52 of tent 50 (FIGS. 10, 13, 15, 16).

At this point, the life support accessories 140 may be positioned inside tent 50 in accordance with the user's preference. Stove 110, flue 112 and air intake pipe 116 are connected to allow heating and cooking of food (FIG. 17).

Preferably, floor panels 12 are rectangular and 48" by 48" in size, although different sizes may be use. Floor panels are preferably made of recyclable materials. When used for recreational purposes, it may be desirable to use smaller floor panels to reduce the weight of shelter 2 to make it easier to transport.

The foregoing descriptions of an exemplary embodiment of the present invention have been presented for purposes of enablement, illustration, and description. It is not intended to be exhaustive of or to limit the present invention to the precise forms discussed. There may be, however, other self-contained shelters not specifically described herein, but with which the present invention is applicable. The present invention should therefore not be seen as limited to the particular embodiment described herein; rather, it should be understood that the present invention has wide applicability with respect to shelters. Such other configurations can be achieved by those skilled in the art in view of the description herein. Accordingly, the scope of the invention is defined by the following claims.

What is claimed is:

1. A self contained shelter comprising:

an enclosure;

a plurality of generally rectangular unattached floor panels contained inside said enclosure, each of said floor panels having a top surface, a bottom surface and four sides;

an inflatable tent having an inner layer and an outer layer contained inside of said enclosure; and a plurality of life-supporting accessories contained inside said enclosure, whereby, said enclosure and said plurality of generally rectangular unattached floor panels connect to form a raised floor.

2. The self-contained shelter according to claim 1, wherein said enclosure further comprises six generally rectangular floor panels, each of said floor panels having a top surface, a bottom surface, and four sides.

3. The self-contained shelter according to claim 2, wherein said floor panels are all the same size.

4. The self-contained shelter according to claim 2, wherein said floor panels each have one or more feet on said bottom surface.

5. The self-contained shelter according to claim 2, wherein each floor panel is attachable along at least one side to a side of another of said floor panels.

6. The self-contained shelter according to claim 5, further including a plurality of braces for mounting between said raised floor and an inner layer of said tent.

7. The self-contained shelter according to claim 1, wherein said enclosure is secured by one or more straps.

8. The self-contained shelter according to claim 1, wherein said inflatable tent is attachable to said raised floor.

9. The self-contained shelter according to claim 8, further comprising a plurality of inflatable beams attachable to an outer layer of said tent.

10. The self-contained shelter according to claim 9, wherein said beams are connected to a beam header disposed on said tent.

11. The self-contained shelter according to claim 10, wherein said beam header includes a plurality of beam sockets for receiving and securing said plurality of beams.

* * * * *